US007338353B2

(12) United States Patent
Lee

(10) Patent No.: US 7,338,353 B2
(45) Date of Patent: Mar. 4, 2008

(54) LOADING DEVICE FOR CHEMICAL MECHANICAL POLISHER OF SEMICONDUCTOR WAFER

(75) Inventor: Jung Hoon Lee, Suwon (KR)

(73) Assignee: Doosan DND Co., Ltd., Ansan, Kyungg-Do (KR)

( * ) Notice: Subject to any disclaimer, the term of this patent is extended or adjusted under 35 U.S.C. 154(b) by 0 days.

(21) Appl. No.: 10/599,861

(22) PCT Filed: Apr. 8, 2005

(86) PCT No.: PCT/KR2005/001030

§ 371 (c)(1),
(2), (4) Date: Mar. 12, 2007

(87) PCT Pub. No.: WO2006/041248

PCT Pub. Date: Apr. 20, 2006

(65) Prior Publication Data

US 2007/0218817 A1 Sep. 20, 2007

(30) Foreign Application Priority Data

Apr. 14, 2004 (KR) ..... 2004-0025588

(51) Int. Cl.
*B24B 5/00* (2006.01)

(52) U.S. Cl. ..... 451/285; 451/398; 451/11

(58) Field of Classification Search ..... 451/11, 451/397, 398, 285–289
See application file for complete search history.

(56) References Cited

U.S. PATENT DOCUMENTS 6,312,312 B1 11/2001 Togawa et al.

(Continued)

FOREIGN PATENT DOCUMENTS

JP 9-254028 9/1997

(Continued)

*Primary Examiner*—Dung Van Nguyen
(74) *Attorney, Agent, or Firm*—Leydig, Voit & Mayer, Ltd.

(57) ABSTRACT

The present invention related to a loading device for a chemical mechanical polisher of semiconductor wafers comprising: a loading cup on wherein a cup plate is installed in a cup-shaped bath, a loading plate for receiving wafers sits on the cup plate, and a plurality of vertical damping devices lie between the cup plate and the loading plate so as for the loading plate to be damped in a vertical direction; a driving axis for a right and left pivot movement and an ascending and descending movement of the loading cup between a platen of the chemical mechanical polisher and a spindle; and an arm connecting the loading cup to the driving axis; wherein a plurality of horizontal damping devices are positioned with a constant angle in a radial direction along a bottom surface of the loading plate from its center in order for a polishing carrier head mounted on the spindle and the loading plate to be detachable after being calibrated to a normal position by shaking the loading plate finely in a horizontal direction within the limit of a certain driving tolerance, based on a position deviation between the polishing carrier head and the loading plate, when loading and unloading wafers therebetween; and wherein both ends of each horizontal damping device are fixed to the cup plate and the loading plate, respectively. With the structure of the loading device, the present invention accomplishes an advantage that the loading device can be actively adapted for a position deviation between the polishing carrier head and the loading cup of the loading device, caused during the process of loading and unloading wafers.

7 Claims, 4 Drawing Sheets

U.S. PATENT DOCUMENTS

| | | | | |
|---|---|---|---|---|
| 6,402,598 | B1 * | 6/2002 | Ahn et al. | 451/65 |
| 7,044,832 | B2 * | 5/2006 | Yilmaz et al. | 451/5 |
| 7,238,087 | B1 * | 7/2007 | Kashiwa et al. | 451/41 |
| 2004/0127142 | A1 * | 7/2004 | Olgado | 451/5 |

FOREIGN PATENT DOCUMENTS

| | | |
|---|---|---|
| JP | 9-277161 | 10/1997 |
| JP | 11-188620 | 7/1999 |
| KR | 2003-067389 | 8/2003 |

* cited by examiner

LOADING DEVICE FOR CHEMICAL MECHANICAL POLISHER OF SEMICONDUCTOR WAFER

TECHNICAL FIELD

The present invention relates to a loading device for a chemical mechanical polisher of semiconductor wafers. More specifically, the present invention relates to a loading device for a chemical mechanical polisher of semiconductor wafers where, even in case that a permissible tolerance upon assembling or operating respective components of the loading device is significantly exceeded during the process of loading and unloading which performs an exchange of wafers between a polishing carrier head and a loading cup of the loading device, the polishing carrier head and the loading cup are smoothly detachable at a normal position so that damages due to the digression of wafers may be prohibited and rapid loading and unloading of wafers is possible which may lead to an enhancement of productivity.

BACKGROUND ART

Generally, a chemical mechanical polisher (CMP) is a tool for flattening a wafer and a thin film thereon in order to reduce irregularities of the a wafer and the thin film which occur due to repeated processes of masking, etching, lining, etc. during the fabrication of semiconductor wafers.

A CMP comprises a platen onto which a grinding pad is attached, a slurry feeder for providing slurry for grinding on the grinding pad, a spindle for providing a physical grinding by holding wafers on the polishing pad by way of a polishing carrier and rotating the wafers in a contact state with the polishing pad, and a loading device for delivering the wafers transferred from a wafer cassette by a robot arm to a position of a polishing carrier head in order to load the wafers to and unload them from the polishing carrier head.

The loading device in a CMP is comprised of a loading cup which receives wafers, a driving axis for a right and left pivot movement and an ascending and descending movement of the loading cup between a platen and a spindle, and an arm connecting the loading cup to the driving axis.

However, because the loading device in a prior art is structured only to perform a right and left pivot movement and an ascending and descending movement of the loading cup about the driving axis when exchanging wafers between the polishing carrier head and the loading cup thereof before and after grinding the wafers, loading and unloading of the wafers can not be made at a normal position unless assembled positions of the polishing carrier head, the spindle, etc. are precisely matched with ascending and descending positions of the loading cup. Accordingly, in case that the position between the polishing carrier head and the loading cup is not possible to be precisely controlled within a limit of a permissible tolerance (typically, within ±0.05° considering an assembly tolerance when the degree of driving accuracy of the spindle including the polishing carrier head is within a limit of ±0.1°), loading and unloading of the wafers in itself cannot be performed, or damages to the wafers may occur due to poor loading of the wafers during a grinding process of the wafers after loading them into the polishing carrier head.

As a result, in order to perform an operation between the polishing carrier head and the loading cup at a normal position, it is required that either a separate position controlling device such as a mechanical actuator capable of controlling the positions of the respective components of the loading device needs to be installed additionally, or a permissible tolerance for a normal position between the polishing carrier head and the loading cup must be maintained within a limit of ±0.05°. In case of installing a separate position controlling device additionally is practically difficult in terms of the device structure considering the size of the loading cup or its water-proof treatment, etc. Further, the time necessary for loading and unloading of wafers takes unbearably long sot that the productivity becomes significantly lowered.

In order to solve the above problems in the prior art, the applicant of the present invention proposed a new loading device in Korean Patent Application No. 2002-0007565 where the new loading device has a vertical damping structure by a compression spring to support the bottom surface of a loading plate upwardly in a loading cup.

The loading cup of the loading device disclosed in Korean Patent Application No. 2002-0007565 (hereinafter '565 Application) has a structure where a cup plate is installed in a cup-shaped bath. A loading plate for receiving a wafer sits on the cup plate. A plurality of compression springs lie between the cup plate and the loading plate where the compression springs are dumped while ascending and descending in a vertical direction. That is, the compression springs support the bottom surface of the loading plate so to make a vacuum adhesion of the wafer being received in the loading plate toward the polishing carrier head, or perform a tilting operation for making a secure contact of the wafer between the bottom surface of the polishing carrier head and the top surface of the loading plate when detaching the vacuum-adhered wafer on the polishing carrier head onto the loading plate.

However, although the structure of the loading cup suggested in '565 Application is capable of loading and unloading wafers more stable compared with the structure of a known loading cup, it may not perform the movement of the loading plate actively in case that the position between the polishing carrier head and the loading cup is deviated from a permissible limit of tolerance of ±0.1° and thus the polishing carrier head and the loading cup are mismatched. Therefore, the structure of the loading cup suggested in '565 Application is not enough to accomplish a practical performance.

DISCLOSURE OF INVENTION

Technical Problem

The object of the present invention is to solve the prior art problems by providing a loading device for a chemical mechanical polisher of semiconductor wafers where, even in case that a permissible tolerance upon assembling or operating respective components of the loading device is significantly exceeded during the process of loading and unloading which performs an exchange of wafers between a polishing carrier head and a loading cup of the loading device, the polishing carrier head and the loading cup are smoothly detachable at a normal position so that damages due to the digression of wafers may be prohibited and rapid loading and unloading of wafers is possible which may lead to an enhancement of productivity.

Technical Solution

To achieve the above object, a loading device for a chemical mechanical polisher of semiconductor wafers according to one aspect of the present invention, comprising: a loading cup on wherein a cup plate is installed in a cup-shaped bath, a loading plate for receiving wafers sits on the cup plate, and a plurality of vertical damping devices lie between the cup plate and the loading plate so as for the loading plate to be damped in a vertical direction; a driving axis for a right and left pivot movement and an ascending and descending movement of the loading cup between a platen of the chemical mechanical polisher and a spindle; and an arm connecting the loading cup to the driving axis; wherein a plurality of horizontal damping devices are positioned with a constant angle in a radial direction along a bottom surface of the loading plate from its center in order for a polishing carrier head mounted on the spindle and the loading plate to be detachable after being calibrated to a normal position by shaking the loading plate finely in a horizontal direction within the limit of a certain driving tolerance, based on a position deviation between the polishing carrier head and the loading plate, when loading and unloading wafers therebetween; and wherein both ends of each horizontal damping device are fixed to the cup plate and the loading plate, respectively.

In addition, each horizontal damping device is comprised of a tension spring both ends of which are fixedly hooked respectively to fixing threads which are fixed to the top surface of the cup plate and the bottom surface of the loading plate, respectively.

Further, it is preferable that a plurality of guide rollers are equidistantly installed along the circumference of the loading plate in a projected way toward the center thereof at an outer periphery area of the loading plate in which a retainer ring mounted on along the circumference of the polishing carrier head is inscribed, in order to minimize the friction caused by contact between the retainer ring and the loading plate. Particularly, each guide roller is comprised of a ball-point roller which has a spiral thread along the outer surface of a spherically shaped roller body A guide ball which rotates upon contact with the retainer ring of the polishing carrier head is mounted on at the front end of the roller body and is partially projected outward from the roller body. A plurality of fine sized bearing balls capable of rotating the guide ball smoothly is disposed inside the roller body on which the guide ball is mounted.

Further, a wafer guide step capable of receiving a certain sized wafer is formed in an inside circumference on the upper surface of the loading plate. The wafer guide step is tilted with a slant angle of 5 to 45° in a way that the circumference of the inner side wall of the wafer guide step is tilted outwardly from its vertical position, so as to easily receive the wafer into the wafer guide step by inertia due to a pivoting movement of the loading cup.

Further, it is preferable that the vertical damping device is comprised of a ball point plunger spring where a support ball is mounted onto upper portion of a spherically shaped casing in which the support ball rotates upon contact thereof with the bottom surface of the loading plate. The support ball is partially projected outward from the top surface of the casing. A plunger is installed inside the casing, which supports the supporting ball resiliently by way of a spring. The lower portion of the plunger may move in and out by a small distance without any interruption through a hole formed at the bottom surface of the casing. A plurality of fine bearing balls for rotating the support ball smoothly is disposed at a contact area between the support ball and the plunger.

Further, it is preferable that a driving tolerance when loading and unloading wafers between the polishing carrier head and the loading plate is set within the limit of ±0.3°.

Advantageous Effect

In accordance with the loading device of the present invention, it is possible to accomplish an effect that even in case that a permissible tolerance upon assembling or operating respective components of the loading device is significantly exceeded during the process of loading and unloading which performs an exchange of wafers between a polishing carrier head and a loading cup of the loading device, the polishing carrier head and the loading cup are smoothly detachable at a normal position so that damages due to the digression of wafers may be prohibited and rapid loading and unloading of wafers is possible which may lead to an enhancement of productivity.

BEST MODE FOR CARRYING OUT THE INVENTION

Hereinafter, a loading device for a chemical mechanical polisher of semiconductor wafers according to preferred embodiments of the present invention is described in more detail by reference to the accompanying drawings.

Figure 1:
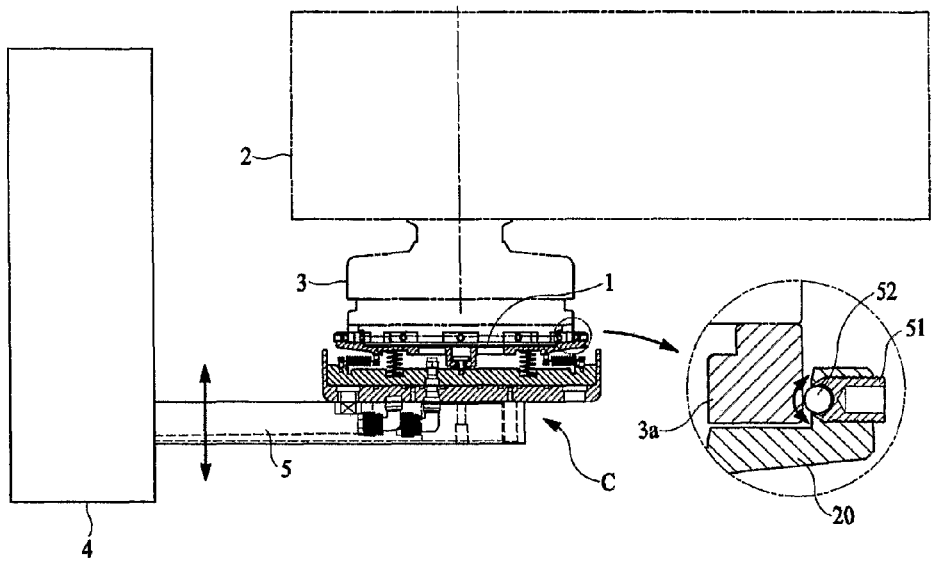
FIG. 1 is a schematic view showing an operational structure at a normal state where a loading device for a chemical mechanical polisher of semiconductor wafers according to the present invention delivers a wafer to be ground after pivoting about a driving axis and ascending to a polishing carrier head, or is delivered the ground wafer 1 from the polishing carrier head.
Figure 2:
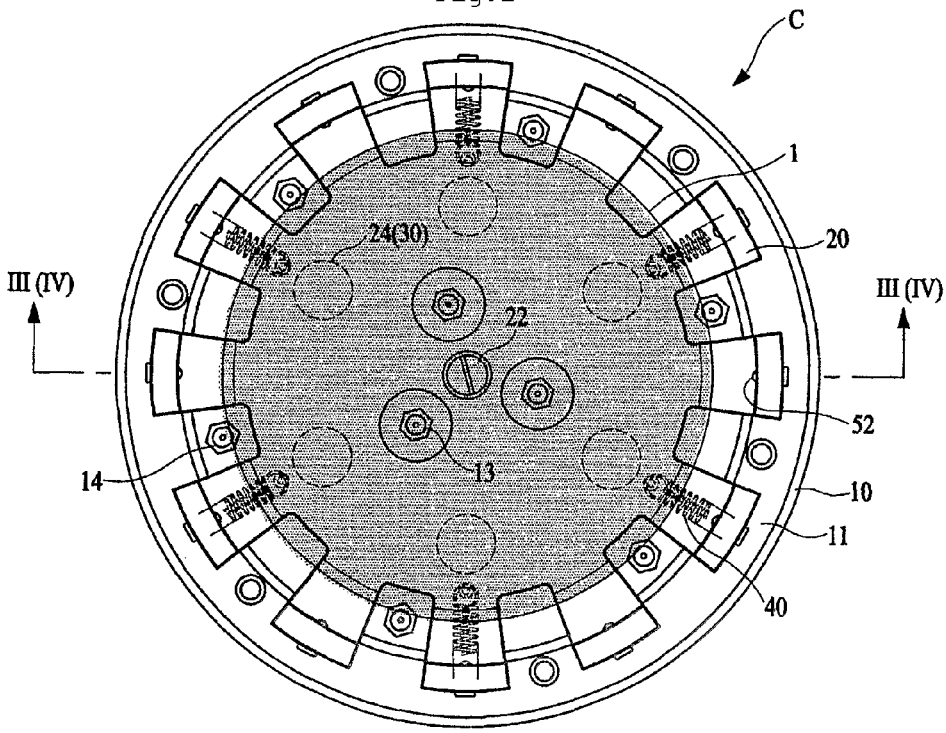
FIG. 2 is a plan view of a loading cup of a loading device in accordance with the present invention.
Figure 3:
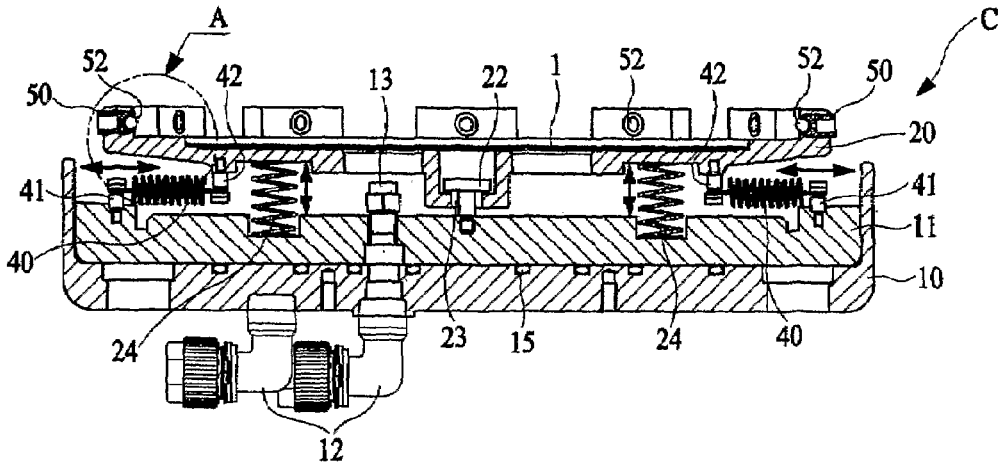
FIG. 3 is a cross-sectional view along the III-III illustrated in FIG. 2 for a loading cup in accordance with one embodiment of the present invention.
Figure 4:
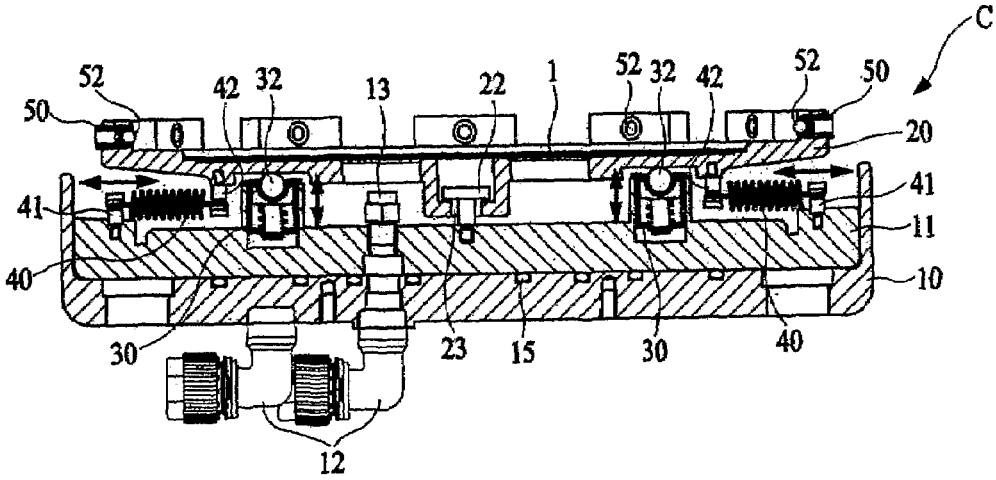
FIG. 4 is a cross-sectional view along the IV-IV illustrated in FIG. 2 for a loading cup in accordance with one embodiment of the present invention.
Figure 5:
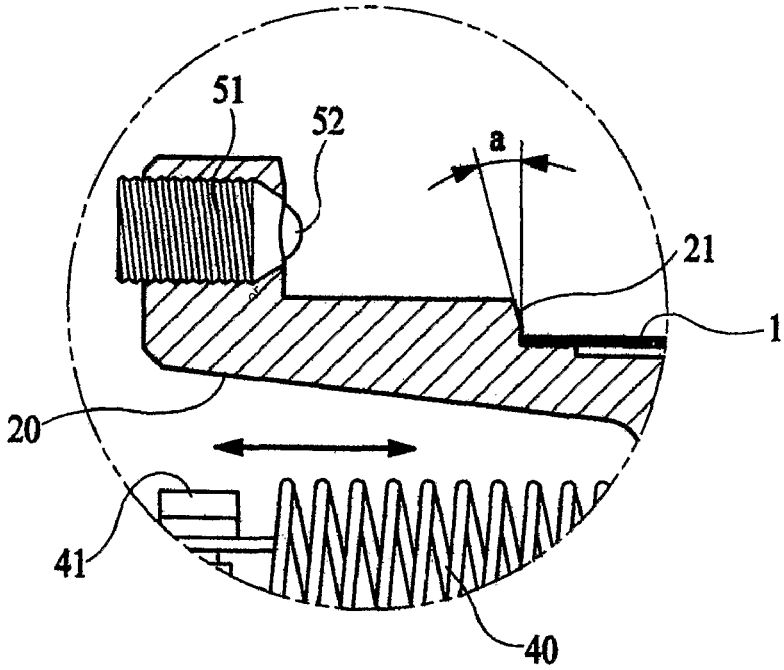
FIG. 5 is an enlarged view of A portion as illustrated in FIG. 3 which shows a structural characteristic of a loading cup in accordance with the present invention.
Figure 6:
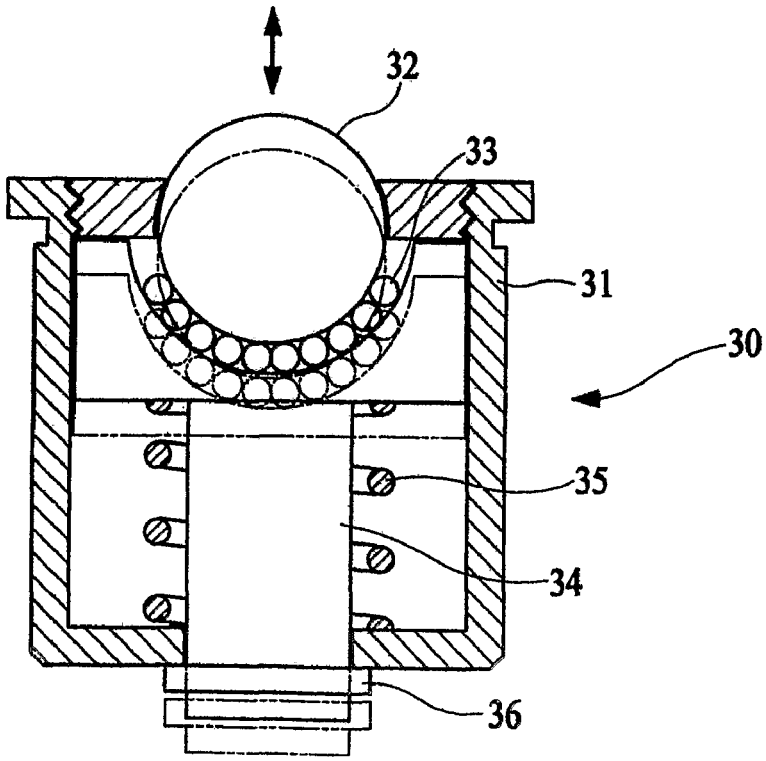
FIG. 6 is a longitudinal cross-sectional view of a vertical damping device (a ball-point plunger spring) which is applied to a preferred embodiment illustrated in FIG. 4.
Figure 7:
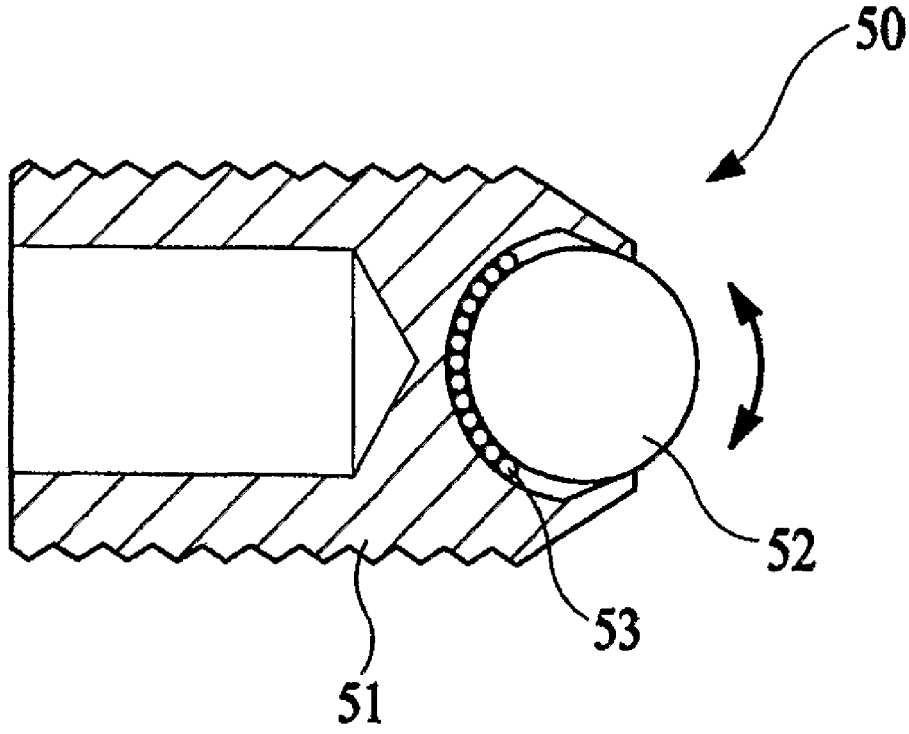
FIG. 7 is a longitudinal cross-sectional view of a structure of a plurality of guide rollers which are positioned radially at a certain constant intervals along the periphery of a loading plate in a loading cup in accordance with one embodiment of an apparatus for controlling length of the present invention.

FIGS. 1 to 7 illustrate a structure of a loading device in accordance with the present invention and a chemical mechanical polisher of semiconductor wafers to which the loading device is applied. FIG. 1 is a schematic view showing an operational structure at a normal state where a loading device for a chemical mechanical polisher of semiconductor wafers according to a preferred embodiment of the present invention delivers a wafer 1 to be ground after pivoting about a driving axis 4 and ascending to a polishing carrier head 3, or is delivered the ground wafer 1 from the polishing carrier head 3. FIG. 2 is a plan view of a loading cup C of a loading device in accordance with the present invention. FIG. 3 is a cross-sectional view along the III-III illustrated in FIG. 2 for a loading cup C in accordance with one embodiment of the present invention. FIG. 4 is a cross-sectional view along the IV-IV illustrated in FIG. 2 for a loading cup C in accordance with one embodiment of the present invention. FIG. 5 is an enlarged view of A portion as illustrated in FIG. 3 which shows a structural characteristic of a loading cup C in accordance with the present invention. FIG. 6 is a longitudinal cross-sectional view of a vertical damping device 30 (a ball-point plunger spring) which is applied to a preferred embodiment illustrated in FIG. 4. FIG. 7 is a longitudinal cross-sectional view of a structure of a plurality of guide rollers 50 which are positioned radially at a certain constant intervals along the periphery of a loading plate 20 in a loading cup C in accordance with one embodiment of an apparatus for controlling length of the present invention.

First, it is understood by any skilled person in the art that the driving tolerance when loading and unloading the wafers between the polishing carrier head 3 and the loading plate 20 in the present invention is set within the limit of ±0.3°. Any skilled person should understand that the limit of tolerance in the present invention guarantees a very efficient driving performance, considering the driving tolerance having a limit of ±0.1° in prior art.

As illustrated in FIG. 1, a loading device for a chemical mechanical polisher of semiconductor wafers in accordance with the present invention comprises a loading cup C on which a wafer 1 sits, a driving axis 4 for a right and left pivot movement and an ascending and descending movement of the loading cup C between a platen (not shown) and a polishing carrier head 3 of a spindle 2, and an arm connecting the loading cup C to the driving axis 4 Cleaning liquid feeders 12 are placed through the arm 5 and is connected to nozzles 13,14 mounted inside the loading cup C. With this structure, the loading cup C in accordance with the present invention is characterized in the improvement of its structure and hereinafter the loading cup C is mainly described.

As illustrated in FIGS. 2, 3 and 4, in the loading cup C in accordance with the present invention, a cup plate 11 is installed in a cup-shaped bath 10. A loading plate 20 for receiving the wafer 1 sits on the cup plate 11. A plurality of vertical damping devices 24 or 30 lie between the cup plate 11 and the loading plate 20 where the vertical damping devices 24 or 30 damp the loading plate 20 by shaking it in a vertical direction. Also, a plurality of horizontal damping devices 40 lie between the cup plate 11 and the loading plate 20 where the horizontal damping devices 40 center the loading plate 20 to be a normal state through actively calibrating the position of the loading plate 20 to a position of the polishing carrier head 3 by shaking the loading plate 20 in a radial and horizontal direction.

That is, the plurality of horizontal damping devices 40 are positioned with a constant angle (e.g., 60°) in a radial direction along a bottom surface of the loading plate 20 from its center. Both ends of each horizontal damping device 40 are fixed to the cup plate 11 and the loading plate 20, respectively. Thus, the polishing carrier head 3 and the loading plate 20 may be detachable as being calibrated to a normal position because the loading plate is shaken finely in a horizontal direction within the limit of a certain driving tolerance, based on a position deviation between the polishing carrier head 3 mounted on the spindle 2 and the loading plate 20, when loading and unloading wafers therebetween. Reference numeral 15 in the drawings is an O-ring which provides a seal between the bath 10 and the cup plate 11.

Herein, as in the prior art structure of vertical damping devices, the vertical damping devices 24 or 30 are provided for supporting the bottom surface of the loading plate 20 so as to make a vacuum adhesion of the wafer 1 being received in the loading plate 20 toward the polishing carrier head 3, or for performing a tilting operation so as to make a secure contact of the wafer 1 between the bottom surface of the polishing carrier head 3 and the top surface of the loading plate 20 when detaching the vacuum-adhered wafer 1 on the polishing carrier head 3 onto the loading plate 20. In FIGS. 3 and 4, there are illustrated of different embodied structures wherein the vertical damping devices 24 shown in FIG. 3 are a known compression spring, while the vertical damping devices 30 shown in FIG. 3 are a ball-point plunger spring.

In other words, the vertical damping devices 24 applied to an embodiment shown in FIG. 3 is comprised of a compression spring both ends of which are directly contacted with the top surface of the cup plate 11 and the bottom surface of the loading plate 20, respectively.

Further, as exemplified in more detail in FIG. 6, the vertical damping device 30 applied to a preferred embodiment shown in FIG. 4 is comprised of a ball point plunger spring where a support ball 32 is mounted onto upper portion of a spherically shaped casing 31 in which the support ball 32 rotates upon contact thereof with the bottom surface of the loading plate 20. The support ball 32 is partially projected outward from the top surface of the casing 31. A plunger 34 is installed inside the casing 31, which supports the supporting ball 32 resiliently by way of a spring 35. The lower portion of the plunger 34 may move in and out by a small distance without any interruption through a hole formed at the bottom surface of the casing 31. A plurality of fine bearing balls 33 for rotating the support ball 32 smoothly are disposed at a contact area between the support ball 32 and the plunger 34. Reference numeral 36 in the drawings refers to a snap ring. The resiliently moving width of the vertical damping devices 30 (i.e., the ball point plunger spring) is limited to around 2.5 mm in a preferred embodiment of the present invention. Typically, the resiliently moving width of the vertical damping devices 30 may be applied to known vertical damping devices selectively, considering the path of the plunger 34 of the ball-point plunger spring 30 which is determined at the time of fabrication thereof.

Meanwhile, the horizontal damping devices 40, as illustrated in FIGS. 3 and 4, are comprised of a tension spring both ends of which are fixedly hooked respectively to fixing threads 41,42 which are fixed to the top surface of the cup plate 11 and the bottom surface of the loading plate 20, respectively.

By way of function of the horizontal damping devices 40 (i.e., the tension spring), the loading plate 20 sifting on the vertical damping devices 24 (i.e., the compression spring) or 30 (i.e., the ball-pointing plunger spring) may be shaken finely and resiliently in a radially horizontal direction so that the loading plate 20 can be actively centered. Particularly, in case that the ball-point plunger spring 30 is applied to as a vertical damping device, the support ball 32 is rotated upon the shaking of the loading plate 20 so that the loading plate 20 may be moved smoothly without friction and be easily returned to its original position after being adapted by a retainer ring 3*a* of the polishing carrier head 3 as well.

In addition, a plurality of guide rollers 50 are equidistantly installed along the circumference of the loading plate 20 in a projected way toward the center thereof at an outer periphery area of the loading plate 20 in which the retainer ring 3*a* mounted on along the circumference of the polishing carrier head 3 is inscribed. With this structure of the guide rollers 50, the friction caused by contact between the retainer ring 3*a* and the loading plate 20 is minimized.

The guide roller 50, as illustrated in the partially magnified view of FIG. 1 and in FIG. 7, is comprised of a ball-point roller which has a spiral thread along the outer surface of a spherically shaped roller body 51. A guide ball 52 which rotates upon contact with the retainer ring 3*a* is mounted on at the front end of the roller body 51 and is partially projected outward from the roller body 51. A plurality of fine sized bearing balls 53 capable of rotating the guide ball 52 smoothly are disposed inside the roller body 51 on which the guide ball 51 is mounted.

By way of function of the guide roller 50, even in case that the polishing carrier head 3 has eccentricity of 135 mm (about 0.60) which leads to a maximum deviation of retainer ring 3*a* of the polishing carrier head 3 being around 1.3 mm, the loading plate 20 is actively adapted to a proper position of the retainer ring 3*a* so that loading and unloading of wafers can be done at a normal position.

Further, a separate jig is used additionally in an assembling process in order to project respective guide balls 52 of the plurality of guide rollers 50 inward the periphery of the loading plate 20 at a constant distance. The jig has an identical shape to correspond to that of the top surface of the loading plate 20. When the jig is installed onto the loading plate 20, the jig has a little bit smaller diameter than the loading plate 20 so that it is concentrically disposed in an overlapping way with the loading plate 20. The circumference of the jig holds a gap with a constant width inwardly along the periphery of the loading plate 20 and thus the respective guide rollers 50 are engaged with the loading plate 20 by rotating the guide rollers 50 until the guide balls 52 of the guide rollers 50 make a contact with the circumference of the jig.

In the meanwhile, a wafer guide step 21 capable of receiving a certain sized wafer 1 is formed in an inside circumference on the upper surface of the loading plate 20 being applied to the present invention, as illustrated in FIG. 5 The wafer guide step 21 is tilted with a slant angle "a" of 5 to 45° in a way that the circumference of the inner side wall of the wafer guide step 21 is tilted outwardly from its vertical position, so as to easily receive the wafer 1 into the wafer guide step 21 by inertia due to a pivoting movement of the loading cup C.

As illustrated in FIGS. 3 and 4, one or more stopper holes 23 are formed at a certain position or positions through the loading plate 20 with symmetry about an origin at a certain position. One or more stopper 22 are secured through into the stopper hole(s) 23 with a certain marginal gap from the cup plate 11 in order to prohibit the loading plate 20 from deviation from the cup plate 11 and the bath 10. In a preferred embodiment of the present invention, one stopper hole 23 is formed at the center of the loading plate 20 and a rivet as the stopper 22 is secured through into the stopper hole 23 with a marginal gap of 2.5 mm or more from the cup plate 11.

Thus, once the loading device in accordance with the present invention is set within the limit of permissible tolerance of ±0.3° for a normal position, which is much wider than the limit of permissible tolerance within ±0.1° in the prior art, then the loading device may be actively adapted by mutually systematic operations of the shape of a loading plate 20 itself, a plurality of guide rollers 50, vertical damping devices 24 or 30, and horizontal damping devices 40.

As described above, although the present invention is described by way of the preferable embodiments, the scope of the present invention should not be limited to the embodiments, but should cover all various modifications that fall upon the scope to be conceived equivalents which are easily modified from the embodiments described in the present invention by a skilled person in the art.

INDUSTRIAL APPLICABILITY

The loading device of the present invention is a useful invention in that even in case that a permissible tolerance upon assembling or operating respective components of the loading device is significantly exceeded during the process of loading and unloading which performs an exchange of wafers between a polishing carrier head and a loading cup of the loading device, the polishing carrier head and the loading cup are smoothly detachable at a normal position so that damages due to the digression of wafers may be prohibited and rapid loading and unloading of wafers is possible which may lead to an enhancement of productivity.

What is claimed is:

1. A loading device for a chemical mechanical polisher of semiconductor wafers comprising:

a loading cup on wherein a cup plate is installed in a cup-shaped bath, a loading plate for receiving wafers sits on the cup plate, and a plurality of vertical damping devices lie between the cup plate and the loading plate so as for the loading plate to be damped in a vertical direction;

a driving axis for a right and left pivot movement and an ascending and descending movement of the loading cup between a platen of the chemical mechanical polisher and a spindle; and an arm connecting the loading cup to the driving axis;

wherein a plurality of horizontal damping devices are positioned with a constant angle in a radial direction along a bottom surface of the loading plate from its center in order for a polishing carrier head mounted on the spindle and the loading plate to be detachable after being calibrated to a normal position by shaking the loading plate finely in a horizontal direction within the limit of a certain driving tolerance, based on a position deviation between the polishing carrier head and the loading plate, when loading and unloading wafers therebetween; and wherein both ends of each horizontal damping device are fixed to the cup plate and the loading plate, respectively.

2. The loading device according to claim 1, wherein each horizontal damping device is comprised of a tension spring both ends of which are fixedly hooked respectively to fixing threads which are fixed to the top surface of the cup plate and the bottom surface of the loading plate, respectively.

3. The loading device according to claim 1, wherein a plurality of guide rollers are equidistantly installed along the circumference of the loading plate in a projected way toward the center thereof at an outer periphery area of the loading plate in which a retainer ring mounted on along the circumference of the polishing carrier head is inscribed, in order to minimize the friction caused by contact between the retainer ring and the loading plate.

4. The loading device according to claim 3, wherein each guide roller is comprised of a ball-point roller which has a spiral thread along the outer surface of a spherically shaped roller body;

wherein a guide ball which rotates upon contact with the retainer ring of the polishing carrier head is mounted on at the front end of the roller body and is partially projected outward from the roller body; and wherein a plurality of fine sized bearing balls capable of rotating the guide ball smoothly are disposed inside the roller body on which the guide ball is mounted.

5. The loading device according to claim 1, wherein a wafer guide step capable of receiving a certain sized wafer is formed in an inside circumference on the upper surface of the loading plate; and wherein the wafer guide step is tilted with a slant angle of 5 to 45° in a way that the circumference of the inner side wall of the wafer guide step is tilted outwardly from its vertical position, so as to easily receive the wafer into the wafer guide step by inertia due to a pivoting movement of the loading cup.

6. The loading device according to claim 1, wherein the vertical damping device is comprised of a ball point plunger spring where a support ball is mounted onto upper portion of a spherically shaped casing in which the support ball rotates upon contact thereof with the bottom surface of the loading plate;

wherein the support ball is partially projected outward from the top surface of the casing;

wherein a plunger is installed inside the casing which supports the supporting ball resiliently by way of a spring;

wherein the lower portion of the plunger may move in and out by a small distance without any interruption through a hole formed at the bottom surface of the casing; and wherein a plurality of fine bearing balls for rotating the support ball smoothly are disposed at a contact area between the support ball and the plunger.

7. The loading device according to claim 1, wherein a driving tolerance when loading and unloading wafers between the polishing carrier head and the loading plate is set within the limit of ±0.3°.

* * * * *